US010041271B2

(12) United States Patent
Jin

(10) Patent No.: US 10,041,271 B2
(45) Date of Patent: Aug. 7, 2018

(54) FOLDABLE TENT

(71) Applicant: Luhua (Xiamen) Trading Co., Ltd. CHINA, Xiamen (CN)

(72) Inventor: Ju Young Jin, Xiamen (CN)

(73) Assignee: Xiamen Innovation Metal Products Co., LTD., Xiamen (CN)

( * ) Notice: Subject to any disclaimer, the term of this patent is extended or adjusted under 35 U.S.C. 154(b) by 0 days.

(21) Appl. No.: 15/217,835

(22) Filed: Jul. 22, 2016

(65) Prior Publication Data

US 2017/0022732 A1 Jan. 26, 2017

(30) Foreign Application Priority Data

Jul. 23, 2015 (CN) ..... 2015 2 0537870 U
Jul. 23, 2015 (CN) ..... 2015 2 0537951 U

(51) Int. Cl.

*E04H 15/36* (2006.01)
*E04H 15/42* (2006.01)
*E04H 15/64* (2006.01)
*E04H 15/48* (2006.01)

(52) U.S. Cl.

CPC ..... *E04H 15/425* (2013.01); *E04H 15/36* (2013.01); *E04H 15/48* (2013.01); *E04H 15/64* (2013.01)

(58) Field of Classification Search

CPC ..... E04H 15/42; E04H 15/36; E04H 15/28; E04H 15/425; E04H 15/64; Y10T 403/44; Y10T 403/55

USPC ..... 135/124, 135–136, 147, 98, 156, 119; 403/217–218

See application file for complete search history.

(56) References Cited

U.S. PATENT DOCUMENTS

| | | | |
|---|---|---|---|
| 14,655 | A | 4/1856 | Hartwell |
| 58,283 | A | 9/1866 | Palmer |
| 379,274 | A | 3/1888 | Hamilton |
| 1,061,547 | A | 5/1913 | Kennedy |
| 1,129,194 | A | 2/1915 | Hanley |
| 1,347,107 | A | 7/1920 | McCann |
| 2,113,118 | A | 4/1938 | Pyatt |
| 2,137,625 | A | 11/1938 | Norvell |

(Continued)

FOREIGN PATENT DOCUMENTS

| | | | |
|---|---|---|---|
| CA | 2 022 369 | A1 | 2/1991 |
| CN | 1076987 | A | 10/1993 |

(Continued)

*Primary Examiner* — Winnie Yip

(74) *Attorney, Agent, or Firm* — Morgan, Lewis & Bockius LLP

(57) ABSTRACT

A foldable tent includes a tent cloth, a plurality of support frame poles to support the tent cloth, and a tent top supporting device. The tent top supporting device includes a cover, a plurality of connection sleeves, and a plurality of inwardly concave recesses. The plurality of inwardly concave recesses is disposed at a peripheral side of the cover. Each recess includes a first side wall and a second side wall disposed on two sides of the recess, and an inner side wall adjacent a center of the cover. Each respective connection sleeve is flippably or rotatably disposed in a corresponding recess, and has one end connected to an end of a corresponding support frame pole. When the foldable tent is unfolded, a side wall of the other end of the corresponding connection sleeve comes into contact and matches with the inner side wall of the corresponding recess.

19 Claims, 16 Drawing Sheets

(56) References Cited

U.S. PATENT DOCUMENTS 2,227,554 A 1/1941 Riordon
2,306,706 A 12/1942 Lucas
2,448,895 A 9/1948 Lawrence
2,530,765 A 11/1950 Greenup
2,555,220 A 5/1951 Brown
2,716,993 A 9/1955 Coderick
2,731,972 A 1/1956 Braun
2,948,287 A 8/1960 Rupert
2,962,034 A 11/1960 Finlayson
2,984,249 A 5/1961 Sears, Jr. et al.
3,054,413 A 9/1962 Eshelman
3,333,373 A 8/1967 Taylor et al.
3,738,378 A 6/1973 Williams
3,766,932 A 10/1973 Sidis
3,810,482 A 5/1974 Beavers
3,929,146 A 12/1975 Maiken
4,077,417 A 3/1978 Beavers
4,148,332 A 4/1979 Huddle
4,201,237 A 5/1980 Watts et al.
4,280,521 A 7/1981 Zeigler
4,285,354 A 8/1981 Beavers
4,627,210 A 12/1986 Beaulieu
4,637,748 A 1/1987 Beavers
4,750,509 A 6/1988 Kim
4,787,182 A 11/1988 Serge
4,819,680 A 4/1989 Beavers
4,827,958 A * 5/1989 Cantwell ..... E04H 15/425 135/119
4,838,003 A 6/1989 Zeigler
4,941,499 A 7/1990 Pelsue et al.
4,944,321 A 7/1990 Moyet-Ortiz
4,971,090 A 11/1990 Uhl
4,998,552 A 3/1991 Niksic et al.
5,230,358 A 7/1993 Forell
5,263,507 A 11/1993 Chuang
5,293,890 A 3/1994 Park et al.
5,328,286 A 7/1994 Lee
5,333,634 A 8/1994 Taylor
5,361,794 A 11/1994 Brady
5,421,355 A * 6/1995 Cantwell ..... E04H 15/425 135/115
5,423,341 A 6/1995 Brady
5,617,681 A 4/1997 Lyons
5,628,338 A 5/1997 Stumbo
5,634,483 A 6/1997 Gwin
5,666,986 A 9/1997 Fox
5,701,923 A 12/1997 Losi, Jr. et al.
5,732,726 A 3/1998 Lee
5,771,651 A 6/1998 Shiina
5,797,695 A 8/1998 Prusmack
5,884,646 A * 3/1999 Ju ..... E04H 15/42 135/124
5,943,837 A 8/1999 Esser et al.
6,021,795 A 2/2000 Long et al.
6,032,430 A 3/2000 Soukup
6,167,898 B1 1/2001 Larga et al.
6,230,728 B1 * 5/2001 Reese ..... E04H 15/28 135/127
6,283,136 B1 9/2001 Chen
6,286,530 B1 9/2001 Hussey
6,296,415 B1 10/2001 Johnson et al.
6,463,948 B2 10/2002 Lee
6,516,823 B1 2/2003 Gloveret et al.
6,591,571 B2 7/2003 Fritsche et al.
6,604,844 B2 8/2003 Hussey
6,666,223 B2 12/2003 Price et al.
6,772,780 B2 8/2004 Price
6,776,179 B1 * 8/2004 Chen ..... E04H 15/42 135/135
6,854,476 B1 * 2/2005 Chai ..... E04H 15/48 135/135
6,868,858 B2 3/2005 Suh
6,874,519 B2 4/2005 Chiang
6,892,744 B2 5/2005 Feldpausch et al.
7,025,075 B2 4/2006 Suh
7,040,585 B2 5/2006 Cheng et al.
7,059,094 B2 6/2006 Yamawaki
D544,941 S 6/2007 Rogers
7,311,113 B2 12/2007 Suh
7,316,239 B2 1/2008 Yang
7,392,610 B2 7/2008 Jedlicka
RE40,544 E 10/2008 Suh
7,481,235 B2 1/2009 Prusmack
7,546,845 B2 6/2009 Prusmack
7,607,447 B1 10/2009 Han
7,628,165 B2 12/2009 Rothweil
7,656,024 B2 2/2010 Elbanhway
7,686,024 B1 3/2010 Lai
7,861,736 B2 1/2011 Choi
7,891,367 B2 2/2011 Ma
8,047,218 B1 11/2011 Shin
8,069,872 B2 12/2011 Bae
8,156,952 B2 4/2012 Chesness
8,186,369 B2 5/2012 Reeb
8,469,045 B2 6/2013 Zhou
8,485,208 B2 7/2013 Seo
8,590,554 B2 * 11/2013 Choi ..... E04H 15/48 135/120.2
D705,884 S 5/2014 Jin
8,763,621 B2 * 7/2014 Jin ..... E04H 15/44 135/115
8,869,814 B2 * 10/2014 Jin ..... E04H 15/16 135/115
8,910,648 B2 12/2014 Jin
9,192,215 B2 * 11/2015 Ma ..... A45B 25/10
9,243,424 B2 * 1/2016 Jin ..... E04H 15/48
2001/0050098 A1 12/2001 Lee
2003/0005953 A1 1/2003 Erbetta et al.
2006/0016467 A1 1/2006 Bae
2006/0289048 A1 12/2006 Choi
2007/0051399 A1 3/2007 Jung
2007/0215192 A1 9/2007 Hoffmann
2012/0318316 A1 12/2012 Choi et al.
2013/0014794 A1 1/2013 Jin
2014/0076372 A1 3/2014 Jin
2014/0109945 A1 4/2014 Jin
2014/0246062 A1 9/2014 Ma
2014/0261601 A1 9/2014 Jin
2014/0290710 A1 10/2014 Choi
2015/0068573 A1 3/2015 Jin
2015/0083177 A1 3/2015 Hotes
2015/0167343 A1 6/2015 Fang
2015/0275541 A1 * 10/2015 Lamke ..... E04H 15/46 135/139
2015/0284974 A1 * 10/2015 Choi ..... E04H 15/32 135/120.3
2016/0242567 A1 * 8/2016 Lime ..... A47C 29/003

FOREIGN PATENT DOCUMENTS

CN 2506736 Y 8/2002
CN 2635827 Y 8/2004
CN 2697225 Y 5/2005
CN 201013097 Y 1/2008
CN 201103269 Y 8/2008
CN 201129060 Y 10/2008
CN 201220478761.4 9/2012
CN 202767622 U 3/2013
CN 203034904 U 7/2013
FR 1 121 851 8/1956
FR 68588 5/1958
GB 2 201 703 A 9/1988
GB 2 259 927 A 3/1993
KR 10-2011-0054253 A 5/2011
WO WO 2011/022764 A1 3/2011

* cited by examiner

FOLDABLE TENT

CROSS-REFERENCE TO RELATED APPLICATIONS

This application claims priority to Chinese Application No. 201520537951.2, filed Jul. 23, 2015, and Chinese Application No. 201520537870.2, filed Jul. 23, 2015, for which the disclosures are hereby incorporated in its entirety.

FIELD OF THE INVENTION

The present invention relates to an outdoor product. More specifically, it relates to a foldable tent or a pole-type tent.

BACKGROUND

Along with continuing rises in living standards, more and more people have come to enjoy independent travel, and a considerable number of those people enjoy camping, outdoor adventures, cycling, and so on. Accordingly, tents, and especially small-size pole-type tents, have become essential items for travel.

Yet common tent top supporting devices currently available on the market typically comprise a cover and a plurality of connection sleeves (the specific number of connection sleeves is dependent on the size of the tent); the connection sleeves are hingedly connected to the cover, which allows the connection sleeves to make a flipping motion along a certain axial line. However, the connection sleeves must not be allowed to make unrestricted flipping motions; their positions must be limited. Currently, a position-limiting plate is typically provided on the tent top and is used for limiting the position of the connection sleeve. However, the addition of the position-limiting plate not only increases the difficulty of production, but also necessitates the consumption of raw materials, which are needed in order to produce the position-limiting plate.

At the same time, after a pole-type tent commonly seen on the market is disassembled, the tent cloth and the support frame poles used for supporting the tent cloth are separated, while the support frame poles are formed by through-connecting a plurality of fibrous tent poles. When it is necessary to pitch the tent, the fibrous tent poles are first connected together to form the support frame poles; then the support frame poles are joined to the tent cloth, stretching and securing the tent cloth. Thus the assembly of the tent is complete. However, the aforementioned manner of pitching a tent is relatively complicated and requires a fairly long time to complete.

SUMMARY OF THE INVENTION

In order to solve the technical problem described above and/or other problems, an objective of the present invention is to provide a foldable tent which modifies the limits that existing tents impose on the position of the connection sleeve, reduces production difficulty, requires fewer raw materials for its production, and reduces production costs.

The present invention is achieved by means of the following technical solutions:

A foldable tent comprises a tent cloth and a plurality of support frame poles used for supporting the tent cloth; one end of the support frame pole is joined to a tent top supporting device; the tent top supporting device comprises a cover and a connection sleeve; a plurality of inwardly concave recesses is uniformly disposed at the peripheral sides of the cover; the connection sleeve is disposed in the recess and makes a flipping motion; one end of the connection sleeve is joined to the support frame pole; the foldable tent is characterized in that the recess comprises a first side wall, a second side wall, and an inner side wall, which are disposed at two sides of the recess, and the inner side wall is close to the center of the cover; when the foldable tent is unfolded, the inner side wall comes into contact with, and fits with, the side wall of the other end of the connection sleeve.

In some embodiments of the present invention, each one of the first side wall and the second side wall is provided with a bolt through-hole, and the bolt through-holes fit each other, the connection sleeve is disposed in the recess through a bolt.

In some embodiments of the present invention, each of the two side walls of the connection sleeve is provided with a pin, the pins fit each other, and each of the first side wall and the second side wall is provided with a slot for snap-connecting the pins.

In some embodiments of the present invention, the slots are arranged from the tops of the first side wall and second side wall to their bottoms, and an opening of each slot is provided with a protrusion.

In some embodiments of the present invention, the support frame pole is formed by at least two pole members joined to each other; the pole member is joined to one end of a hook of a frame pole hook, and the frame pole hook slides along the pole member via the hook; the other end of the frame pole hook is joined to the tent cloth, adjacent pole members are through-connected via a connection tube, and each of the pole members is provided with a frame pole hook.

In some embodiments of the present invention, one end of the support frame pole is joined to the tent top supporting device, connection members are provided at the peripheral sides of the bottom of the tent cloth, and the other end of the support frame pole is fittedly joined to one connection member.

In some embodiments of the present invention, the connection member is a U-shaped member, an opening of the U-shaped member is fixedly connected to the bottom of the tent cloth, and the other end of the support pole member is sleeved within the U-shaped member.

In some embodiments of the present invention, the connection member is a connection piece made of plastic material, and a connection hole is provided on the connection piece; a snap-connection member is provided on one end of the support frame pole, and the snap-connection member is snap-connected in the connection hole.

In some embodiments of the present invention, the snap-connection member comprises a sleeve, one end of the sleeve is connected with a snap-connection block, and a notch fitting the connection hole is provided on the snap-connection block.

In some embodiments of the present invention, a pair of symmetrical notches are provided at the connection between the snap-connection block and the sleeve.

In comparison to the prior art, the present invention has the following advantages:

1. The present invention modifies the limits that existing tents impose on the position of the connection sleeve, reduces production difficulty, requires fewer raw materials for its production, and reduces production costs.

2. When disassembling the tent of the present invention, the support frame pole need not be separated from the tent cloth, such that the frame pole hook is always joined to the pole member and may slide on the pole member without becoming detached from the pole member; thus the subsequent unfolding of the tent is made easier: after the support frame poles are connected, assembly of the tent is complete. The tent of the present invention is simple and quick to assemble, and the time needed for assembling or disassembling the tent is greatly reduced.

DETAILED DESCRIPTION

In the following detailed description, component numbers will be identified in the accompanying illustrations to become a part thereof, and will be represented in a specific manner of exemplary description that allows implementation of the corresponding embodiment. Such embodiments would provide sufficient details to enable a person of ordinary skill in the art to implement the present invention. It is to be understood by the reader that other embodiments may also be employed to implement the present invention, or that certain structural, logical, or electrical modifications could be made without departing from the embodiments provided in the present invention. Therefore, the detailed descriptions provided below should not be regarded as limiting the present invention. Rather, the scope of the embodiments contained therein is defined by the claims of the present invention.

Figure 1:
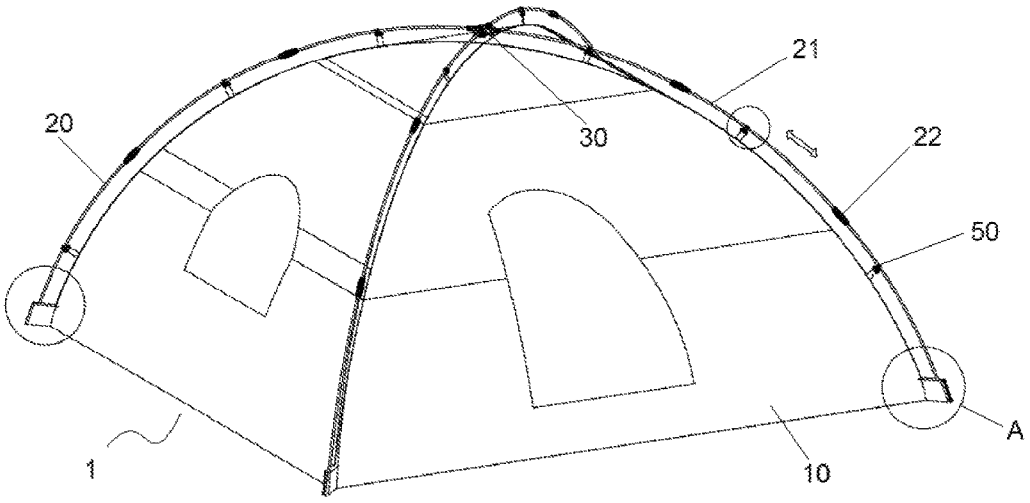
FIG. 1 is a schematic view illustrating a foldable tent in accordance with some embodiments of the present invention.

With reference to FIG. 1, the present invention discloses a foldable tent 1, comprising a tent cloth 10 and a plurality of support frame poles 20 used for supporting the tent cloth; one end of the support frame pole is joined to a tent top supporting device 30; the tent top supporting device comprises a cover 31 and a connection sleeve 32; a plurality of inwardly concave recesses or slots 33 is disposed, preferably uniformly disposed, at the peripheral sides of the cover; the connection sleeve is disposed in the recess and can rotate or make a flipping motion, and the flipping motion of the connection sleeve facilitates the assembly and disassembly of the tent of the present invention; one end of the connection sleeve is joined to the support frame pole. In the present invention, the support frame pole is insertedly connected to a corresponding connection sleeve; the recess comprises a first side wall 331 and a second side wall 332, which are disposed on two sides of the recess, and an inner side wall 333 adjacent the center of the cover; when the foldable tent is being unfolded, the inner side wall is in contact with, and fits with, a side wall 321 of the other side of the connection sleeve. Specifically, with reference to FIGS. 5 to 10, when the connection sleeve is in a horizontal or a substantially horizontal position, the position of the connection sleeve must be limited in order to ensure that the tent is pitched successfully; at that point, the aforementioned inner side wall is in contact with the side wall of the other side of the connection sleeve; in other words, said side walls abut against each other, thus preventing the connection sleeve from flipping downward.

In some embodiments of the present invention, the connection sleeve is joined to the recess in one of the two ways described below. However, their connection is not limited to those two ways.

The First Embodiment

Figure 2:
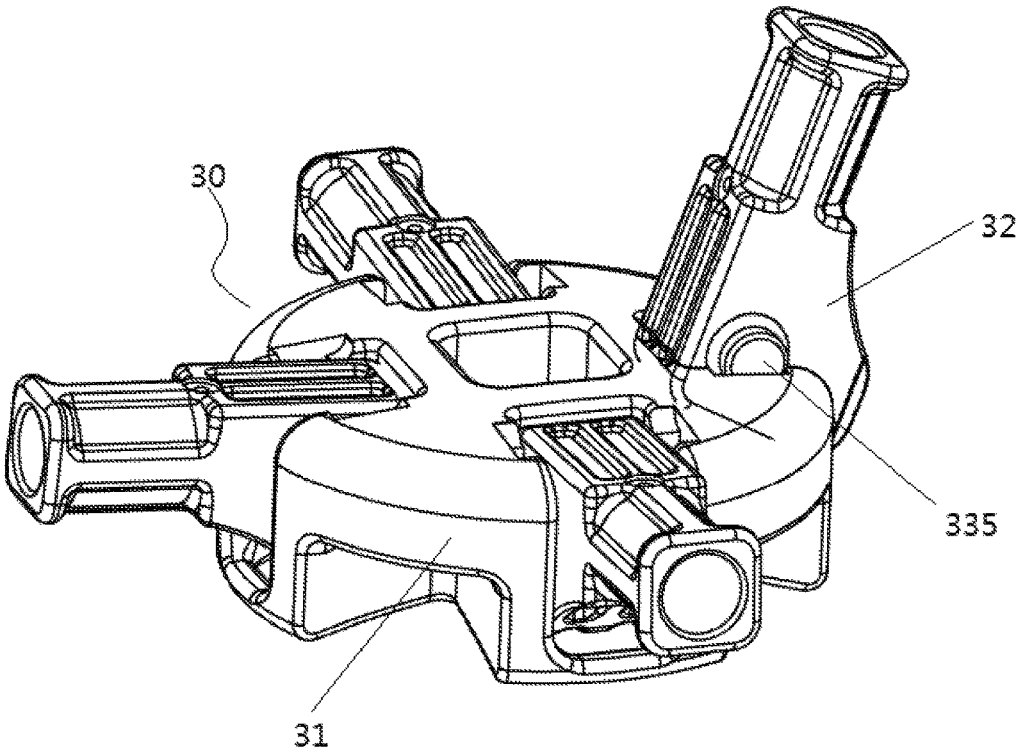
FIG. 2 is a schematic view illustrating the first embodiment of the connection sleeve and recess of the present invention.
Figure 3:
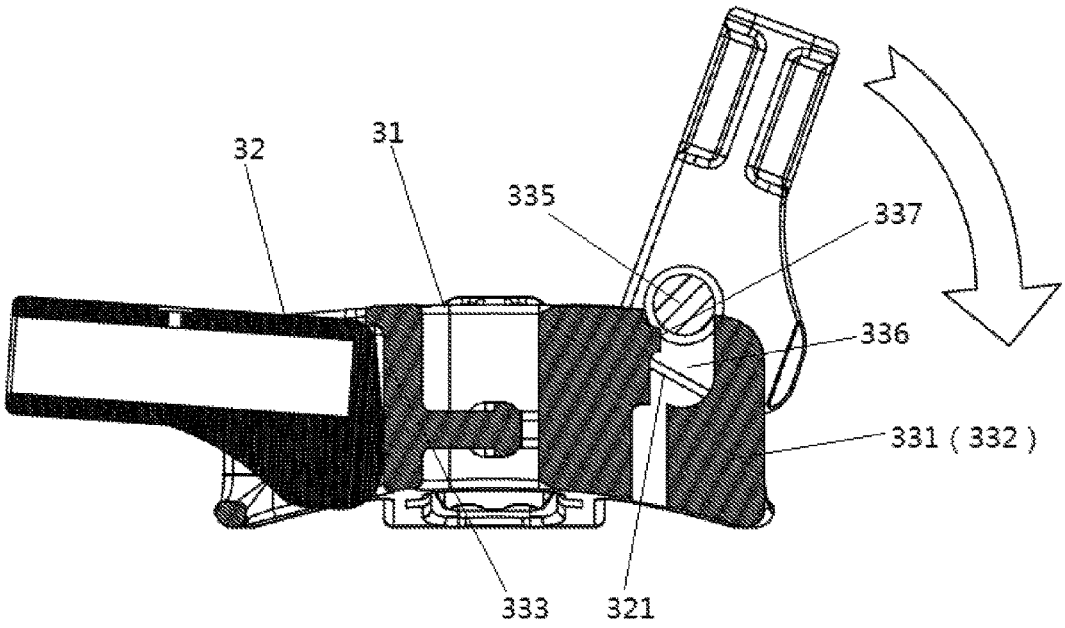
FIG. 3 is a sectional view of FIG. 2.

With reference to FIGS. 2 and 3, each of the two side walls of the connection sleeve is provided with a pin 335, and the pins fit each other; each of the first side wall and the second side wall is provided with a slot 336 for snap-connecting the pin. The slot of the first side wall and the slot of the second side wall are arranged downward from the top of the respective side wall, and the opening on each slot is provided with a protrusion 337.

In the embodiment, a rounding treatment is performed on the connection between the slot and the upper and lower sides of the protrusion. During the process of installation, the pin is snap-connected in the corresponding slot. Specifically, when the pin is located above the protrusion, a force is applied to the connection sleeve, causing the pin to cross the protrusion. The protrusion thus limits the position of the pin, preventing the pin from detaching from the slot when flipping.

The Second Embodiment

Figure 4:
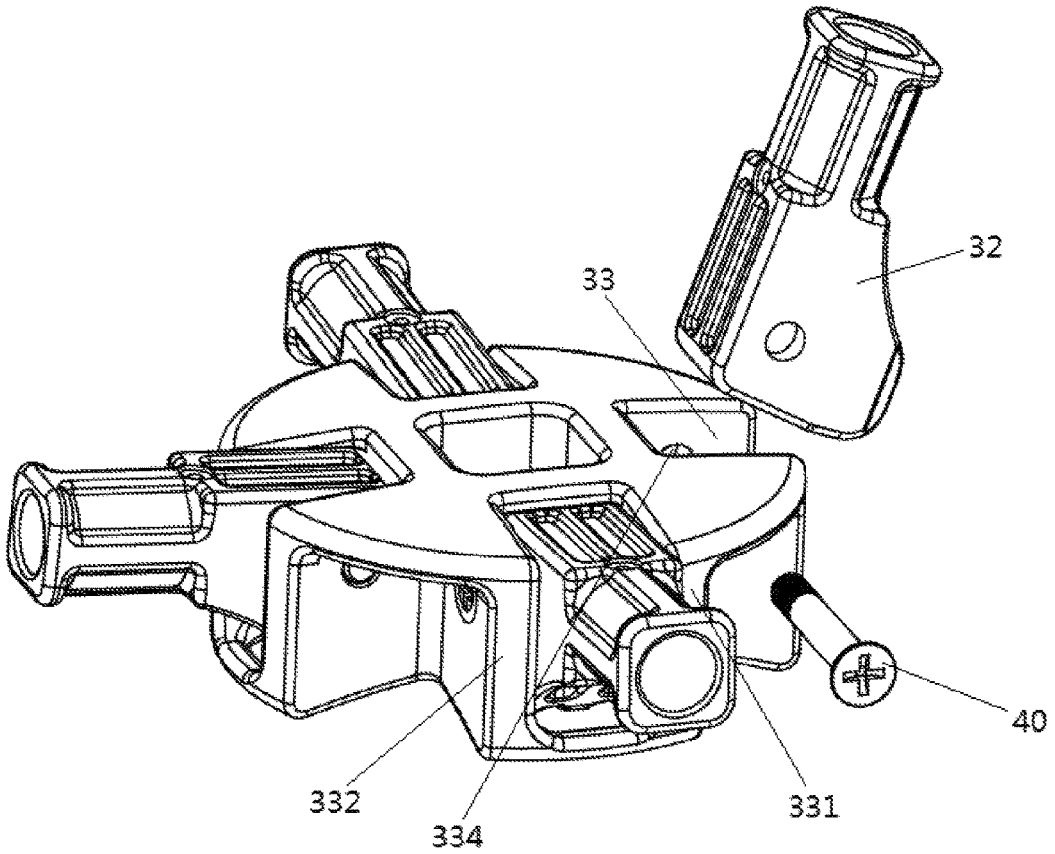
FIG. 4 is a schematic view illustrating the second embodiment of the connection sleeve and recess of the present invention.
Figure 5:
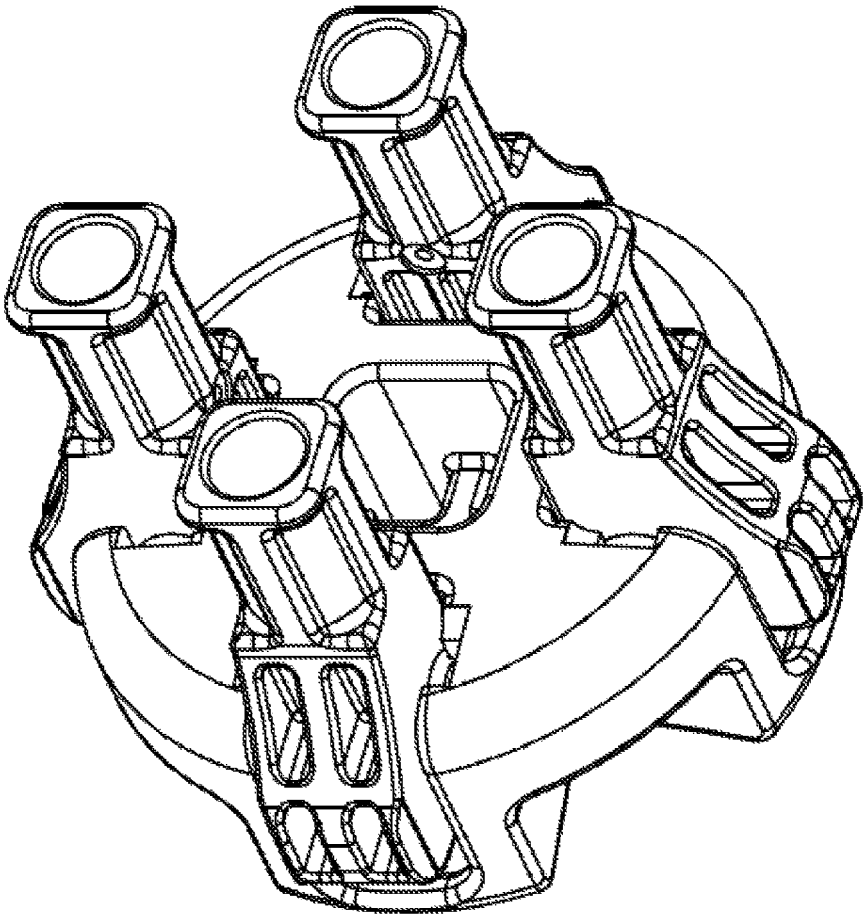
FIG. 5 is a schematic view illustrating the tent top supporting device after folding the tent of the present invention.
Figure 6:
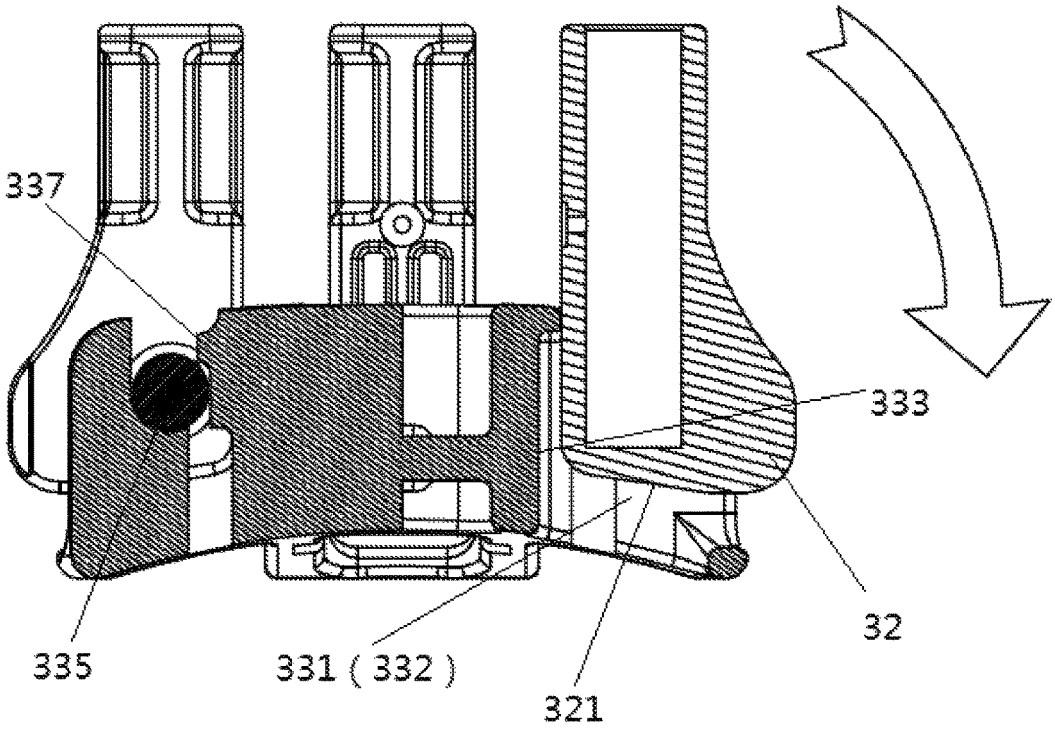
FIG. 6 is a sectional view of FIG. 5.
Figure 7:
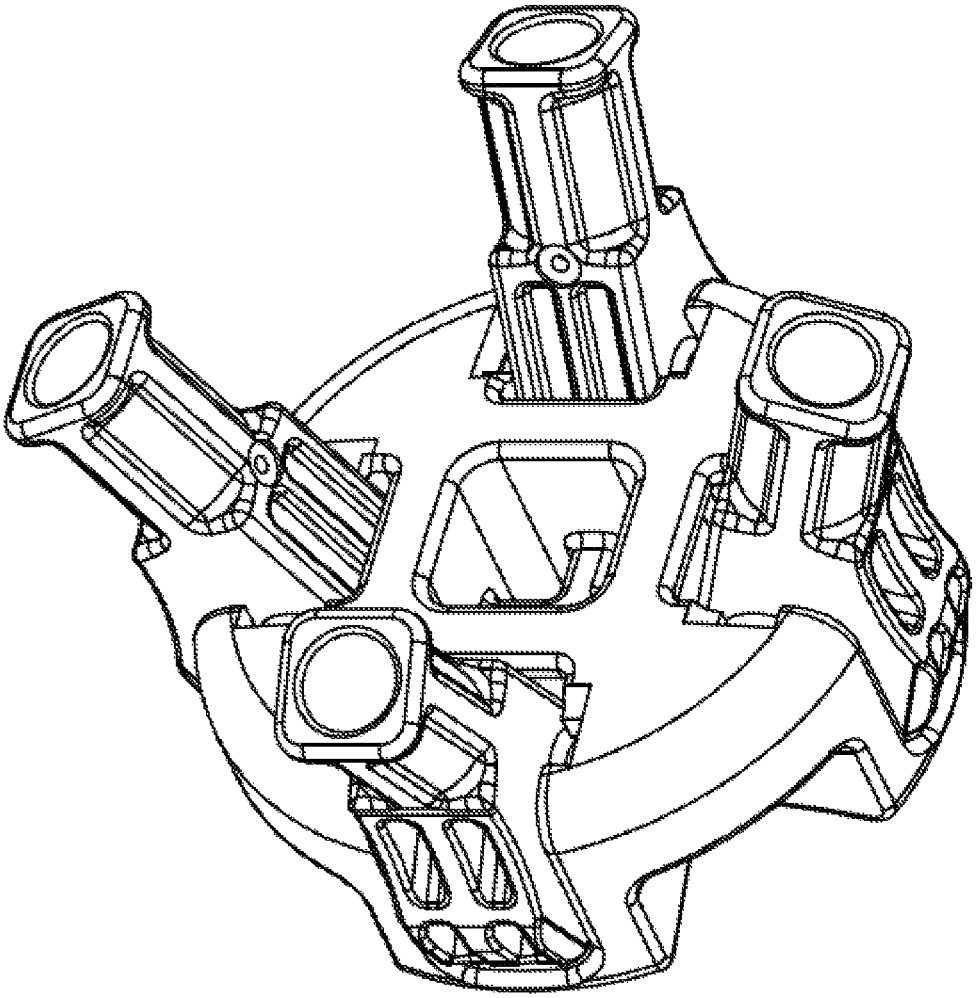
FIG. 7 is a schematic view illustrating the tent top supporting device when unfolding the tent of the present invention.
Figure 8:
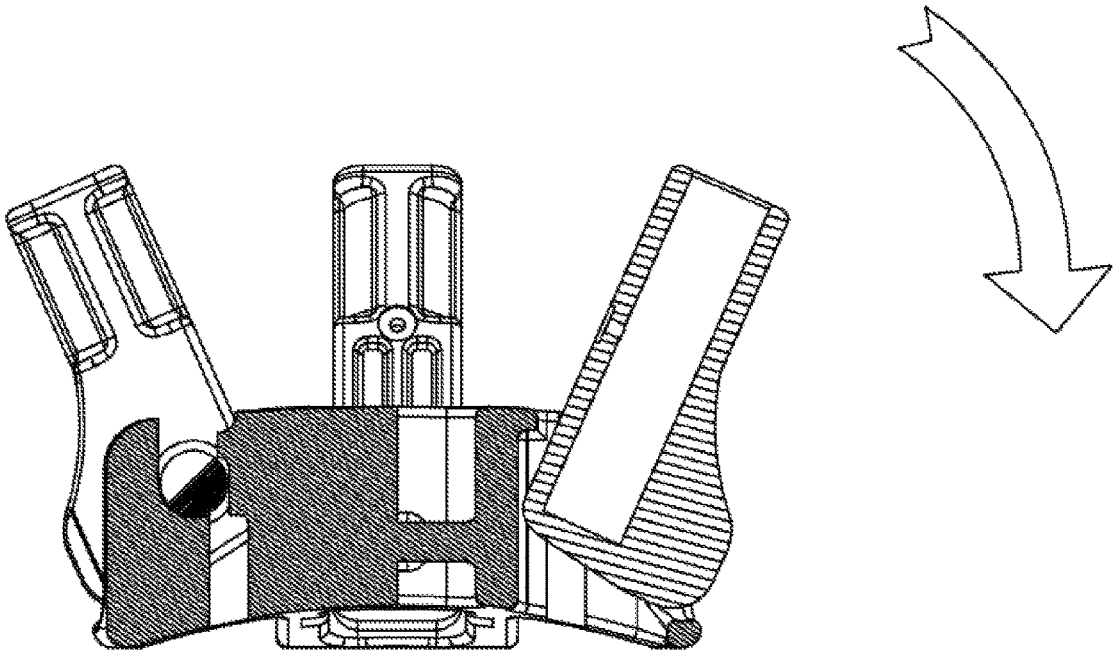
FIG. 8 is a sectional view of FIG. 7.
Figure 9:
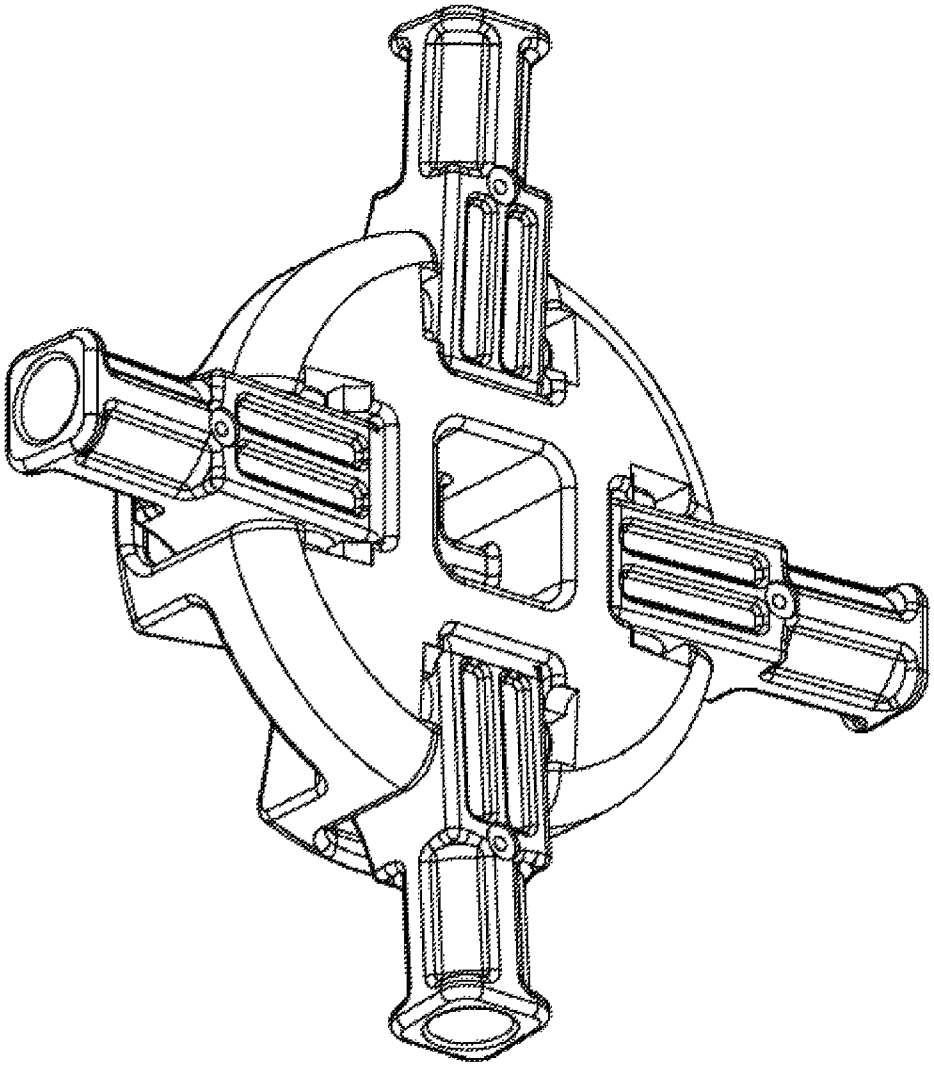
FIG. 9 is a schematic view illustrating the tent top supporting device after unfolding the tent of the present invention.
Figure 10:
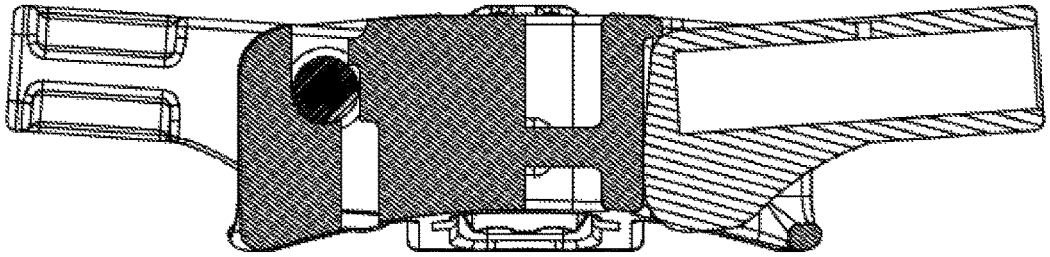
FIG. 10 is a sectional view of FIG. 9.
Figure 11:
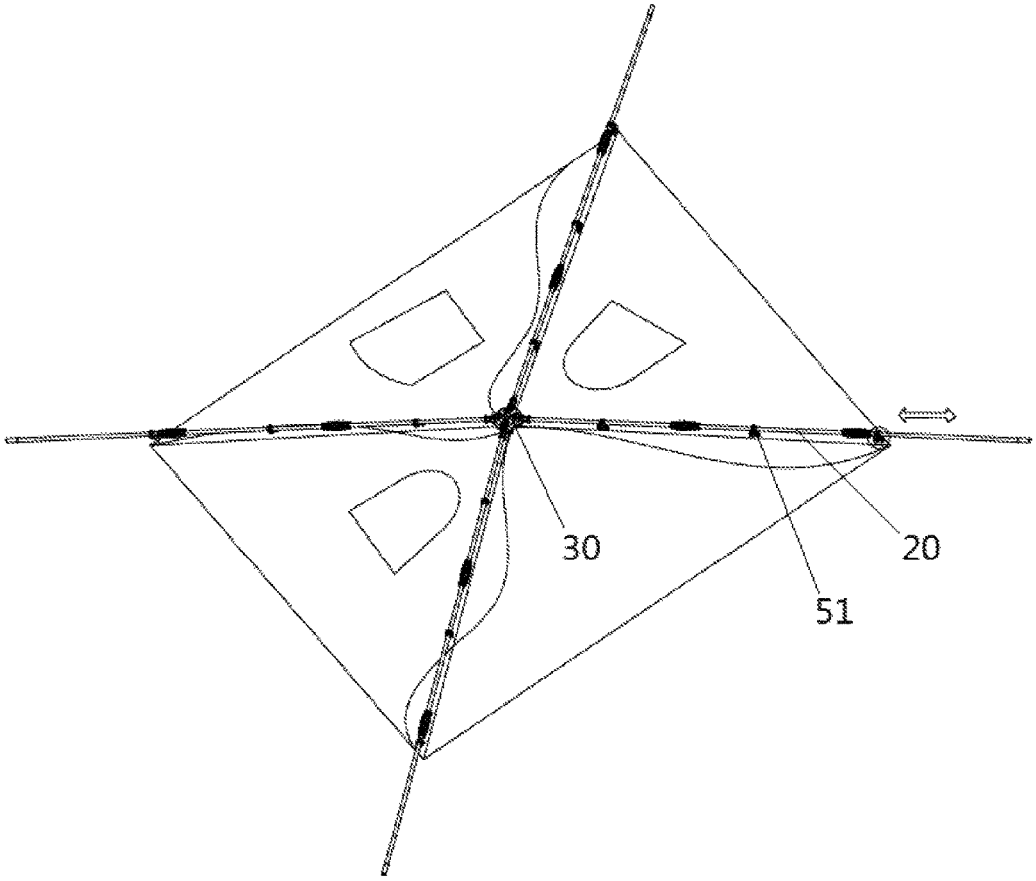
FIG. 11 is a schematic view illustrating the connection between the tent cloth and the support frame pole of the present invention.
Figure 12:
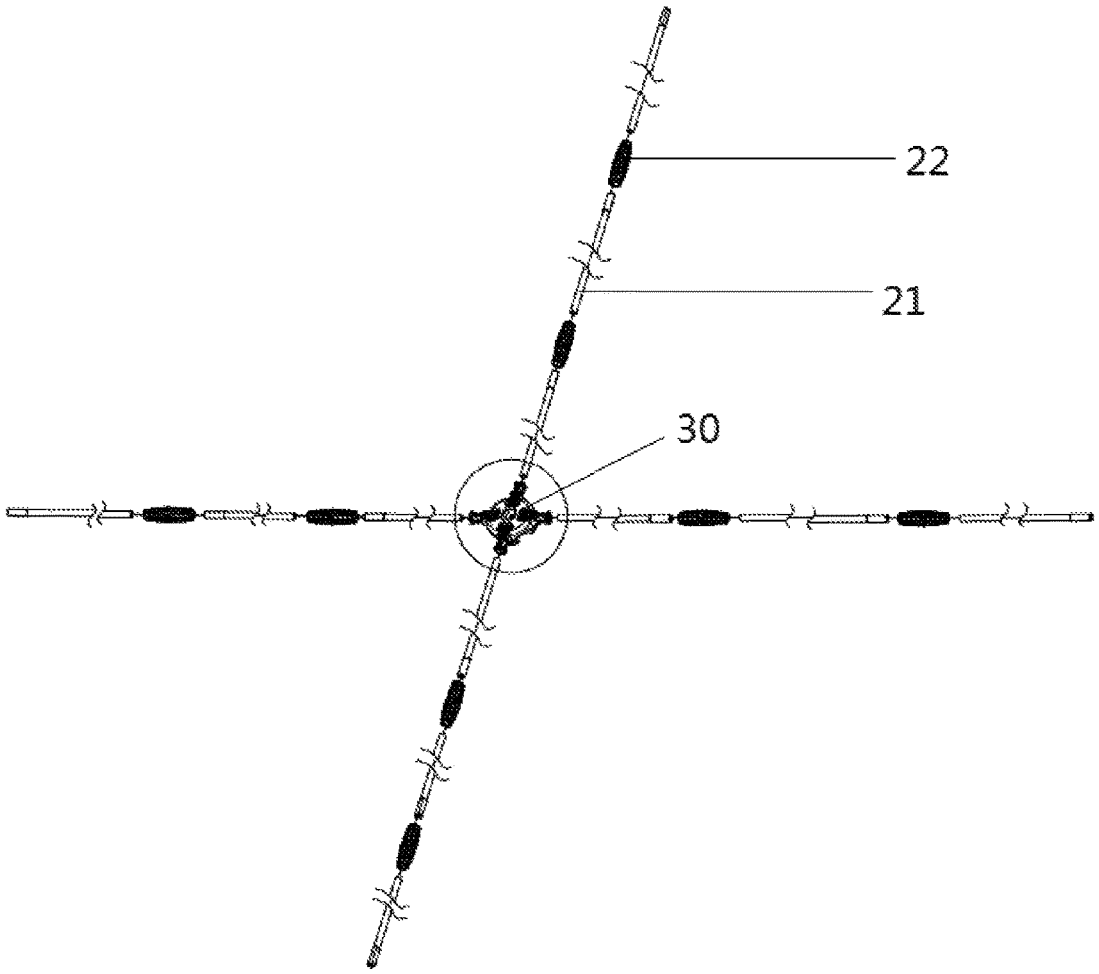
FIG. 12 is a schematic view illustrating the connection between the support frame pole and the tent top supporting device of the present invention.

With reference to FIG. 4, each one of the first side wall and the second side wall is provided with a bolt connection through-hole 334, said bolt connection through-holes match with each other, and the connection sleeve is disposed in the recess via a bolt 40. In the present embodiment, it is necessary only to make the bolt pass in sequence through the first side wall, the connection sleeve, and the second side wall. Of course, the order in which the bolt passes through the first side wall and the second side wall may be reversed. The connection sleeve is also provided with a hole through which the bolt passes.

In the present invention, when the assembly of the tent is complete, the connection sleeve is almost in a horizontal position; when the tent is to be disassembled, the connection sleeve flips upward until the top of the connection sleeve is in a position almost parallel to the inner side wall. The top of the connection sleeve, as mentioned above, refers to the top of the connection sleeve when the process of pitching the tent is complete.

Figure 13:
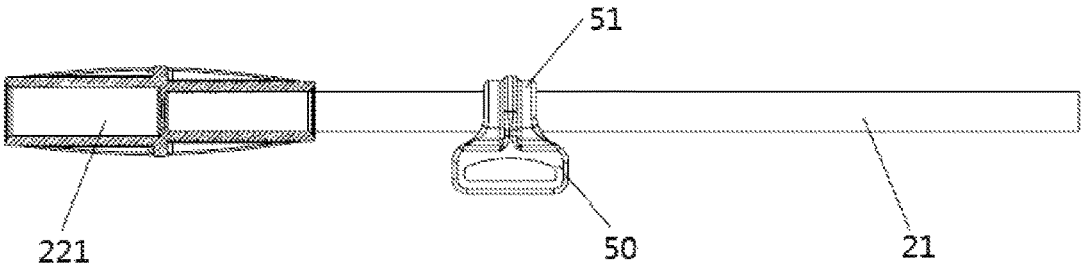
FIG. 13 is a schematic view illustrating the connection between the frame pole hook and the pole member of the present invention.

In a preferred embodiment of the present invention, the support frame pole 20 is formed by at least two pole members 21 joined to each other, and the specific quantity of pole members is determined according to the size of the tent. As shown in the figures of the present invention and by way of example, the support frame pole includes three pole members. one or each pole member is latched to one end of a hook 51 of a frame pole hook 50 as shown in FIG. 13; the frame pole hook slides along the pole member via the hook 51. The sliding motion mentioned above occurs mainly during assembly or disassembly of the tent. The other end of the frame pole hook is joined to the tent cloth. A cloth strap is typically used to achieve the connection between the frame pole hook and the tent cloth. However, no limitation is made that only a cloth strap may be used for such a connection. Adjacent pole members are through-connected via a connection tube 22; an opening 221 is provided at each of the two ends of the connection tube and is used for receiving the pole member inserted therein. The two openings are used primarily for limiting the position of the frame pole hook, thus ensuring that the frame pole hook may slide only on the pole member snap-fitted thereto, and will not slide onto an adjacent pole member. In the present invention, the length of the pole member is relatively short, therefore each of the pole members is provided with one frame pole hook. In a case where the length of the pole member is long enough, two or more than two frame pole hooks may be provided on each pole member. The quantity of frame pole hooks associated with a pole member is determined by the length of the pole member. In the present invention, the connection tube is made from a plastic material or a metal material.

One end of the aforementioned support frame pole is joined to the tent top supporting device; connection members 11 are provided at the peripheral sides of the bottom of the tent cloth, and the other end of said support frame pole is connected to a connection member. In this way, support of the tent is accomplished.

The aforementioned connection member can be configured in a variety of ways. By way of example, two exemplary embodiments will now be further described.

The First Embodiment of the Connection Member

Figure 14:
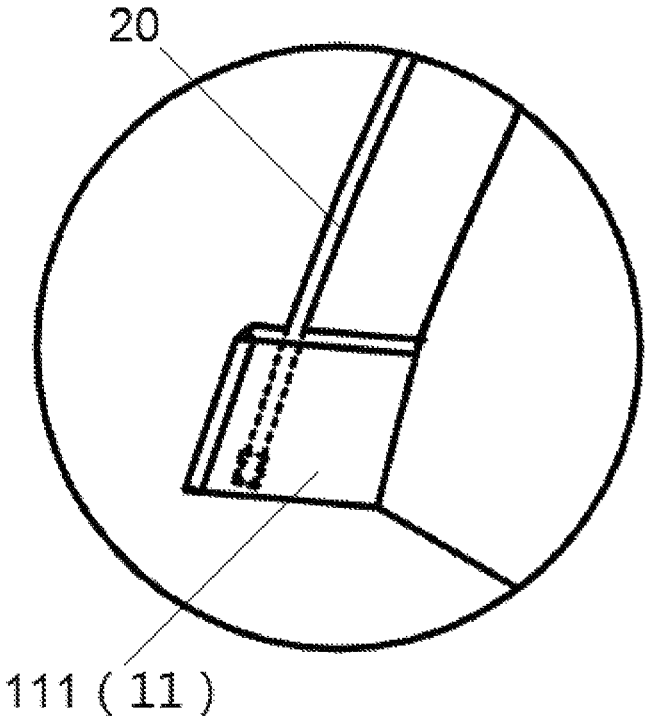
FIG. 14 is a schematic view illustrating the first embodiment of the connection member of the present invention.

The connection member is a U-shaped member 111, an opening of the U-shaped member is fixedly connected to the bottom of the tent cloth, and the other end of the support frame pole is disposed within the U-shaped member. Preferably, the U-shaped member is a cloth strap; the two ends of the cloth strap are stitched to the bottom of the tent cloth. When in use, one needs only place the other end of the support frame pole into the space enclosed by the cloth strap, as illustrated in FIG. 14.

The Second Embodiment of the Connection Member

Figure 15:
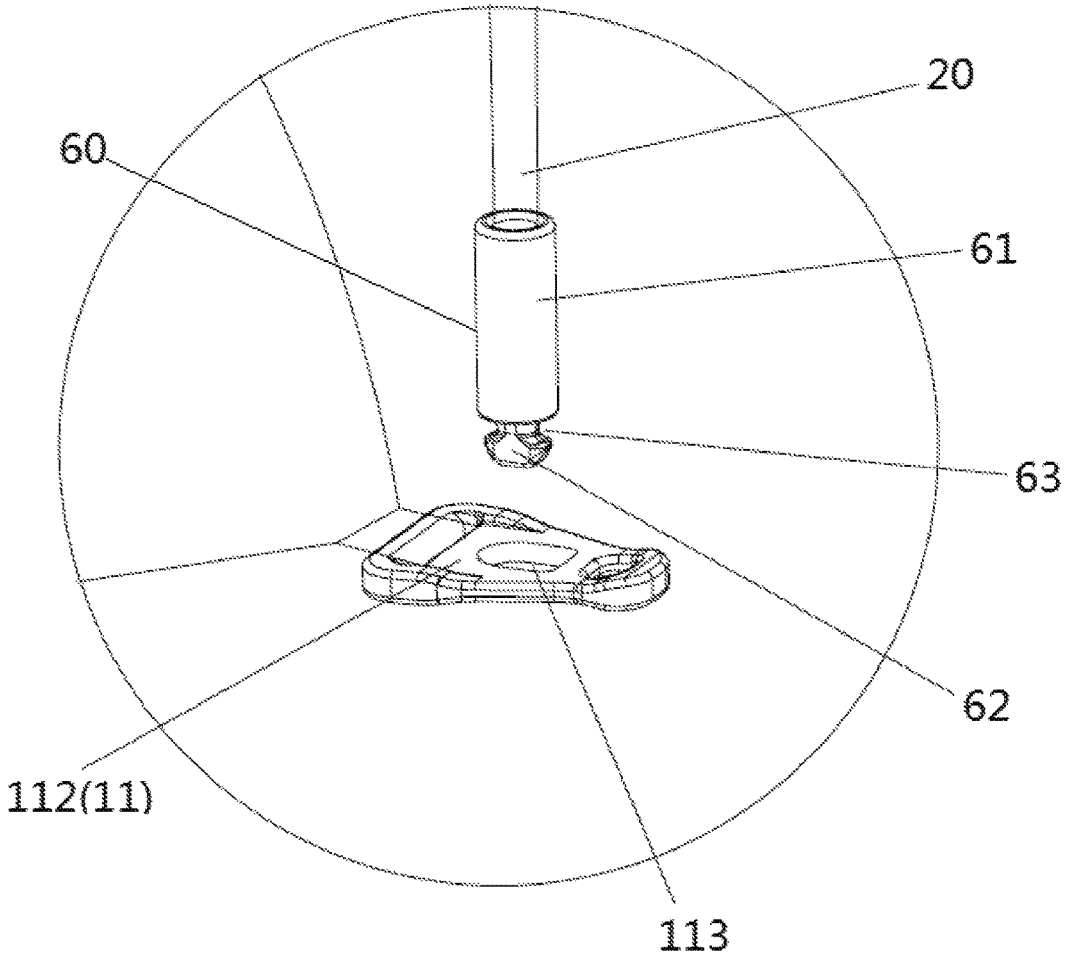
FIG. 15 is a schematic view illustrating the first state of the second embodiment of the connection member of the present invention.
Figure 16:
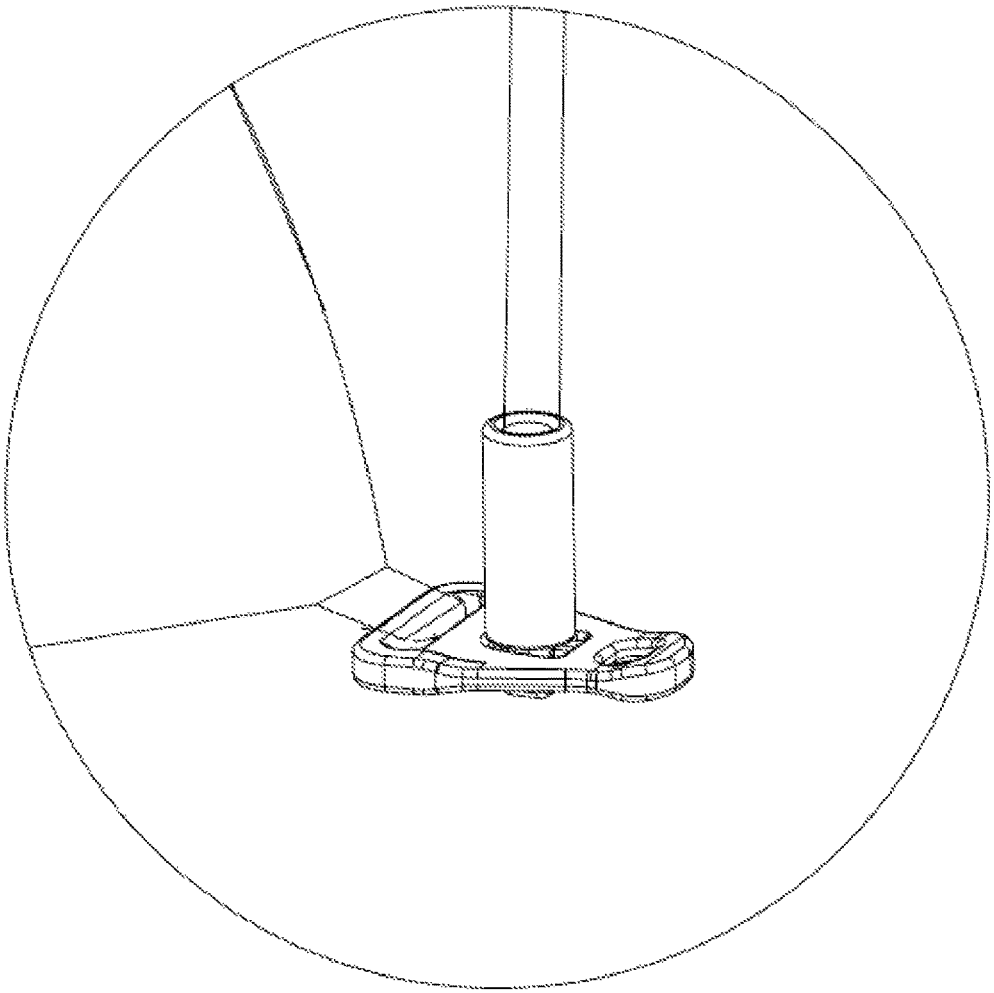
FIG. 16 is a schematic view illustrating the second state of the third embodiment of the present invention.

The connection member is a connection piece 112 made of plastic material, and a connection hole 113 is provided on the connection piece; a snap-connection member 60 is provided on one end of the support frame pole, and the snap-connection member is snap-connected in the connection hole. Specifically, the snap-connection member comprises a sleeve 61, one end of the sleeve is connected to a snap-connection block 62, and a notch 63 fitting the connection hole is provided on the snap-connection block. In addition, a pair of symmetrical notches is provided at the connection between the snap-connection block and the sleeve. The cross-section of the snap-connection-block end facing the notch is larger than the cross-section of the connection hole; the cross-section of one end of the sleeve also is larger than the cross-section of the connection hole. When in use, the snap-connection block is passed through the connection hole, causing the notch and the connection hole to fit each other. Since the connection member is a plastic member, it is unnecessary to exert a large effort to cause the connection member to pass through the sleeve, as illustrated in FIGS. 15 and 16.

When disassembling the tent, the connection member on the bottom of the tent cloth is first detached from its fit with the other end of the support frame pole; then each pole member is detached to disassemble the support frame poles; next, the tent cloth is folded according to the specific lengths of the respective pole members until reaching the last pole member; the connection sleeve is flipped, completing the process of disassembling the tent. The support frame poles need not be separated from the tent cloth. The tent may be assembled by following the described steps in reverse order. Simply put, the support frame poles are first put together; the other end of the support frame pole is then fitted to the connection member on the bottom of the tent cloth; the assembly process is thus complete, as one end of the support frame pole has already been joined to the connection sleeve of the tent top supporting device.

The embodiments described above are merely the exemplary embodiments of the present invention, and do not limit the scope of patent protection of the present invention. Certain changes, modifications, or other equivalent alterations made by any person of ordinary skill in the art without departing from the spirit and scope of the present invention would fall within the scope of patent protection of the present invention.

What is claimed is:

1. A foldable tent, comprising:

a tent cloth;

a plurality of support frame poles to support the tent cloth; and a tent top supporting device comprising a cover, a plurality of connection sleeves, and a plurality of inwardly concave recesses, wherein the plurality of inwardly concave recesses is disposed at a peripheral side of the cover, wherein each recess comprises a first side wall and a second side wall disposed on two sides of the recess, and an inner side wall adjacent a center of the cover, wherein the inner side wall comprises a first surface substantially parallel to a central axis of the cover; and each respective connection sleeve is flippably or rotatably disposed in a corresponding recess, and has one end connected to one end of a corresponding support frame pole, wherein a bottom surface of the other end of each respective connection sleeve is oblique with respect to a longitudinal axis of the respective connection sleeve such that when the foldable tent is unfolded, the bottom surface of the other end of the respective connection sleeve abuts against the first surface of the inner side wall of the corresponding recess to prevent the respective connection sleeve from rotating further downwardly.

2. The foldable tent as set forth in claim 1, wherein each of the first side wall and the second side wall is provided with a bolt through-hole, said bolt through-holes are matched with each other, and the connection sleeve is disposed in the recess via a bolt.

3. The foldable tent as set forth in claim 2, wherein the support frame pole comprises at least two pole members, wherein adjacent two pole members are through-connected to each other via a connection tube; and one or each pole member is slidably latched to a hook of a frame pole hook, wherein the frame pole hook is slidable along the pole member via the hook, and connected to the tent cloth.

4. The foldable tent as set forth in claim 1, wherein each of the two side walls of the connection sleeve is provided with a pin, said pins are matched with each other, and each of the first side wall and the second side wall is provided with a slot for snap-connecting the pin.

5. The foldable tent as set forth in claim 4, wherein the slots are arranged from tops to bottoms of the first side wall and second side wall, and an opening of each slot is provided with a protrusion.

6. The foldable tent as set forth in claim 4, wherein the support frame pole comprises at least two pole members, wherein adjacent two pole members are through-connected to each other via a connection tube; and one or each pole member is slidably latched to a hook of a frame pole hook, wherein the frame pole hook is slidable along the pole member via the hook, and connected to the tent cloth.

7. The foldable tent as set forth in claim 5, wherein the support frame pole comprises at least two pole members, wherein adjacent two pole members are through-connected to each other via a connection tube; and one or each pole member is slidably latched to a hook of a frame pole hook, wherein the frame pole hook is slidable along the pole member via the hook, and connected to the tent cloth.

8. The foldable tent as set forth in claim 1, wherein one end of the support frame pole is connected to the tent top supporting device, and the other end of the support frame pole is connected to a corresponding connection member provided at a peripheral side of a bottom of the tent cloth.

9. The foldable tent as set forth in claim 8, wherein the connection member is a connection piece made of a plastic material, and comprises a connection hole; and a snap-connection member is provided on the other end of the support frame pole, and snap-fitted in the connection hole.

10. The foldable tent as set forth in claim 1, wherein the plurality of inwardly concave recesses is uniformly disposed at the peripheral side of the cover.

11. The foldable tent as set forth in claim 1, wherein the support frame pole comprises at least two pole members, wherein adjacent two pole members are through-connected to each other via a connection tube; and one or each pole member is slidably latched to a hook of a frame pole hook, wherein the frame pole hook is slidable along the pole member via the hook, and connected to the tent cloth.

12. The foldable tent as set forth in claim 1, further comprising:

a plurality of frame pole hooks, each connected to the tent cloth and comprising a hook;

wherein each support frame pole in the plurality of support frame poles comprises at least two pole members connected to each other, wherein one or each pole member is slidably latched to the hook of a corresponding frame pole hook, wherein the frame pole hook is slidable along the pole member via the hook, wherein each support frame pole has one end connected to the tent top supporting device and the other end connected to a corresponding connection member provided at a peripheral side of a bottom of the tent cloth.

13. The foldable tent as set forth in claim 12, wherein the connection member is a U-shaped member with an opening, wherein the opening of the U-shaped member is fixedly connected to the bottom of the tent cloth, and the other end of the support pole member is sleeved in the U-shaped member.

14. The foldable tent as set forth in claim 12, wherein the connection member is made of a plastic material and comprises a connection hole, wherein the other end of the support pole member is provided with a snap-connection member to be snap-connected with the connection hole.

15. The foldable tent as set forth in claim 14, wherein the snap-connection member comprises:

a sleeve to receive the other end of the support pole member; and a snap-connection block connected to the sleeve, wherein the snap-connection block is provided with a notch to fit with the connection hole.

16. The foldable tent as set forth in claim 14, wherein the snap-connection member comprises:

a sleeve to receive the other end of the support pole member; and a snap-connection block connected to the sleeve, wherein the snap-connection block is provided with a pair of symmetrical notches to fit with the connection hole.

17. The foldable tent as set forth in claim 12, wherein adjacent two pole members of a support frame pole are through-connected to each other via a connection tube.

18. The foldable tent as set forth in claim 1, wherein the other end of the respective connection sleeve is asymmetric with a thicker portion to assist in abutting the inner side wall of the corresponding recess to prevent the respective connection sleeve from rotating further downwardly.

19. The foldable tent as set forth in claim 18, wherein the thicker portion is at a lower half of the other end of the respective connection sleeve when the foldable tent is unfolded.

* * * * *